US006964119B2

(12) United States Patent
Weaver, III

(10) Patent No.: US 6,964,119 B2
(45) Date of Patent: Nov. 15, 2005

(54) FOOTWEAR WITH IMPACT ABSORBING SYSTEM

(76) Inventor: Robert B. Weaver, III, 804 144th Ave., Wayland, MI (US) 49348

( * ) Notice: Subject to any disclaimer, the term of this patent is extended or adjusted under 35 U.S.C. 154(b) by 0 days.

(21) Appl. No.: 10/407,121

(22) Filed: Apr. 4, 2003

(65) Prior Publication Data

US 2003/0188455 A1 Oct. 9, 2003

Related U.S. Application Data

(63) Continuation-in-part of application No. 09/878,021, filed on Jun. 8, 2001, now Pat. No. 6,557,271.

(51) Int. Cl.[7] ..... A43B 13/18
(52) U.S. Cl. ..... 36/27; 36/35 B; 36/29
(58) Field of Search ..... 36/27, 89, 35 B, 36/29, 144, 7.8

(56) References Cited

U.S. PATENT DOCUMENTS

| | | | | | |
|---|---|---|---|---|---|
| 4,366,634 | A | | 1/1983 | Giese et al. | 36/114 |
| 4,492,046 | A | * | 1/1985 | Kosova | 36/27 |
| 4,766,681 | A | | 8/1988 | O'Rourke et al. | 36/114 |
| 4,887,367 | A | | 12/1989 | Mackness et al. | 36/129 |
| 5,138,776 | A | * | 8/1992 | Levin | 36/38 |
| 5,279,051 | A | | 1/1994 | Whatley | 36/114 |
| 5,493,792 | A | | 2/1996 | Bates et al. | 36/28 |
| 5,496,263 | A | | 3/1996 | Fuller, II et al. | 602/27 |
| 5,544,429 | A | | 8/1996 | Ellis, III | 36/114 |
| 5,561,920 | A | | 10/1996 | Graham et al. | 36/27 |
| 5,564,203 | A | | 10/1996 | Morris | 36/50.1 |
| 5,651,195 | A | | 7/1997 | Clancy | 36/11.5 |
| 5,657,767 | A | | 8/1997 | Nelson et al. | 128/882 |
| 5,659,982 | A | | 8/1997 | Muraoka et al. | 36/131 |
| 5,678,330 | A | | 10/1997 | Van Dyke et al. | 36/89 |
| 5,692,319 | A | | 12/1997 | Parker et al. | 36/50.1 |
| 5,771,608 | A | | 6/1998 | Peterson | 36/89 |
| 5,833,640 | A | | 11/1998 | Vazquez, Jr. et al. | 602/27 |
| 5,865,778 | A | | 2/1999 | Johnson | 602/27 |
| 5,875,569 | A | | 3/1999 | Dupree | 36/103 |
| 5,896,683 | A | | 4/1999 | Foxen et al. | 36/89 |
| 6,007,506 | A | | 12/1999 | Heil | 602/23 |
| 6,029,376 | A | | 2/2000 | Cass | 36/50.1 |
| 6,083,184 | A | | 7/2000 | Kenosh | 602/27 |
| D429,877 | S | | 8/2000 | Lozano et al. | D2/972 |
| 6,098,313 | A | | 8/2000 | Skaja | 36/28 |
| 6,115,942 | A | * | 9/2000 | Paradis | 36/27 |
| 6,115,943 | A | | 9/2000 | Gyr | 36/35 R |
| 6,119,373 | A | | 9/2000 | Gebhard et al. | 36/114 |
| 6,141,889 | A | | 11/2000 | Baum | 36/140 |
| 6,163,982 | A | | 12/2000 | Ellis, III | 36/25 R |
| 6,247,249 | B1 | * | 6/2001 | Lindqvist | 36/28 |
| 6,557,271 | B1 | * | 5/2003 | Weaver, III | 36/27 |

* cited by examiner

*Primary Examiner*—Ted Kavanaugh
(74) *Attorney, Agent, or Firm*—Van Dyke, Gardner, Linn & Burkhart, LLP

(57) ABSTRACT

An article of footwear includes a sole, an upper portion, and an energy storage system. The upper portion includes a shell for enclosing a user's foot therein. The energy storage system extends between the upper portion and the sole and converts impact forces generated by the user at the heel portion of the shell into propulsion forces to thereby enhance the user's performance.

26 Claims, 16 Drawing Sheets

FOOTWEAR WITH IMPACT ABSORBING SYSTEM

This application is a continuation-in-part of application Ser. No. 09/878,021, filed Jun. 8, 2001 now U.S. Pat. No. 6,557,271, which is incorporated by reference herein in its entirety.

TECHNICAL FIELD AND BACKGROUND OF THE INVENTION

The present invention generally relates to footwear and, more particularly, to footwear that provides increased stability, cushioning, and, further, that facilitates an enhanced performance for the wearer of the footwear.

When running, a runner's foot transitions through three phases of contact with each stride. Initially, a runner's foot typically lands on its heel. As a result, the heel experiences a significant impact or shock, which is absorbed by the heel bone (calcaneum). Because this is a dynamic force, the impact on the heel can be multiples of the runner's body weight. Furthermore, this impact is transmitted up toward the runner's leg joints.

The second phase initiates when the runner's body weight shifts forward. When the runner's body weight shifts forward, the force shifts away from the heel towards the middle portion of the foot. In addition, the arch of the foot spreads out, with the sole taking up the entire weight of the body. Then the foot rolls toward the metatarsals, which creates a torsional twisting effect due to asymmetrical nature of the foot, including the varying lengths of the toes. This may cause the foot to tilt toward to the inside (medial portion) of the foot or to the outside (lateral portion) of the foot placing additional strains on the joints and ligaments.

As the foot continues to roll forward and the runner's weight is transferred to the forefoot and the metatarsal bones, the force exerted is actually increased to and in some cases several multiples of the runner's body weight. This stress is distributed across the whole width of the forefoot by the muscles, ligaments, and tendons across the metatarsals.

In an attempt to reduce the impact forces on knees and ankle joints, current shoe designs incorporate a wide variety of means to cushion the foot. For example, some athletic shoes include air pockets that are incorporated into the sole of the shoe. However, some researchers believe that some cushioning can actually increase the impact forces. Others believe that not only can cushioning actually lead to an increase in the impact on the wearer's joints but it may also put the wearer at greater risk for injury.

Other problems addressed by shoe manufacturers, especially athletic shoe manufacturers, include reducing ankle strain due to over rotation. Typically, the ankle is one of the most vulnerable joints in the body, especially when engaging in athletic activities. Ankle sprains occur usually from excessive rotation of the ankle joint—both inversion and eversion rotation of the ankle joint. Further, it is believed that one most likely to incur an ankle sprain injury during the initial contact phase, known as the Passive contact phase; in which the ankle joint rotates through plantar-flexion and on into a dorsi-flexion rotation. In an attempt to reduce the risk of ankle injury, athletic shoe manufacturers have designed footwear that restricts both medial and lateral motion of the ankle to thereby limit both internal and external rotation of the ankle. However, by restricting the ankle motion, shoe manufactures often hinder the natural motions of the foot and ankle, which tends to reduce the user's athletic performance.

Consequently, there is a need to provide footwear that reduces the risk of injury to the wearer, especially to the wearer's ankle, and in a manner that enhances the wearer's performance, whether that performance is an athletic activity, such as running, playing basketball, playing tennis, hiking, playing racket ball, or a non-athletic activity, such as standing, for example at work, therapeutic exercises, walking, orthotics, or the like.

SUMMARY OF THE INVENTION

Accordingly, the present invention provides footwear that enhances the wearer's performance while preferably reducing the stress on the joints of the wearer and likelihood of ankle strain.

In one form of the invention, an article of footwear includes a sole, an upper portion, and an energy storage system. The upper portion includes a shell for enclosing a user's foot therein. The energy storage system extends between the upper portion and the sole and absorbs, stores, and then converts impact forces into propulsion forces to thereby enhance the user's performance.

In one aspect, the energy storage system incorporates an energy storage member that compresses in response to the impact forces generated by the user and then rebounds after the user rotates forward (during the absorption of the impact forces), and then releases to generate propulsion forces in a direction angled with respect to the direction of the impact forces. For example, the energy storage member may be configured to convert some of the impact forces into a forward propulsion force that enhances, for example, a runner's performance. Alternately, or in addition, the energy storage member may convert some of the impact forces into a generally vertical propulsion force, which may be more suitable for a basketball player, long jumper, or other activities in which the user wishes to convert their horizontal energy into vertical acceleration.

In other aspects, the energy storage system reduces overturning moment forces on the user's ankle. For example, the energy storage system may include a suspension system that transfers reaction forces from the sole to above the bottom of the heel portion of the shoe and, preferably, to a height at or near the user's ankle joint, such as the centroid, which reduces the overturning moment forces on the user's ankle. Optionally, the energy storage system may include two or more energy storage members, with one storage member providing resistance over a first range of motion and the other providing resistance over a second range of motion.

In yet another form of the invention, an article of footwear includes a sole, an upper portion, which is coupled to the sole, and an energy storage system. The sole has a curved lower surface that extends generally from the heel area of the sole to at least the middle portion of the sole. The energy storage system initially absorbs at least some of the impact forces and releases the absorbed energy when the user's foot has pivoted about the curved lower surface. When the user's foot has pivoted, the energy storage system is reoriented with respect to the shoe's initial orientation (during the initial impact) to an intermediate orientation such that when the energy storage system releases the stored energy when in its intermediate orientation the energy is released at a rotated angle with respect to the shoe's initial orientation thus generating propulsion forces for the wearer.

In a further form of the invention, an article of footwear includes a sole and an upper portion, which forms a shell for enclosing a user's foot. The article further includes an energy storage member that extends through at least a portion of the footwear between the sole and the upper portion along the longitudinal axis of the footwear. The energy storage member has a variable spring constant across its longitudinal extent so that the energy storage member generates a varying resistance along the longitudinal axis of the footwear.

In one aspect, the energy storage member comprises a sinusoidal-shaped cushioning member. For example, the sinusoidal-shaped cushioning member may have a sinusoidal shape that decays, with the variable spring constant increasing, toward the toe region of the footwear.

In one aspect, only one end of the sinusoidal-shaped cushioning member is anchored to the shoe, wherein the cushioning member may deflect, elongate, and compress when a load is applied, for example, during running.

In other aspects, the coefficient of friction between the sinusoidal-shaped cushioning member and the upper portion of the footwear and/or between the cushioning member and the sole can be adjusted, for example, which adjusts the firmness of the cushioning member. For example, the sinusoidal-shaped member may be enclosed within an air-tight membrane, which serves to protect the member from dirt and debris.

In one aspect, the sinusoidal cushioning member comprises a plastic cushioning member, such as a thermoplastic cushioning member, or a fiber reinforced composite cushioning member or a metal cushioning member.

According to yet a further aspect, the article of footwear further includes a second energy-absorbing member. For example, the second energy absorbing member may comprise a bladder positioned adjacent the sinusoidal cushioning member or a spring that converts impact forces into propulsion forces for the wearer. In yet a further aspect, the footwear includes both a bladder and a spring or a spring alone.

In another form of the invention, an article of footwear includes a sole, an upper portion, and a pair of springs. The springs transfer the reaction forces from the sole to said upper portion. Each of the spring members includes a first spring portion for connecting to the upper portion, a second spring portion for connecting to the sole, and a middle portion that extends between the first and second spring portions. The middle portion extends forwardly of the first and second spring portions wherein the first portion deflects about the medial portion to define a first moment arm upon initial contact with a ground surface. When the user's body weight shifts forward, the first spring portion translates forward with respect to the second spring portion and the middle portion. As the user's body weight continues to shift forward, past the middle portion, the front spring portion rolls about the middle portion and, thereafter, generates a propulsion force for the user of the footwear.

In one aspect, the spring members each comprise a generally C-shaped member. For example, the C-shaped members may comprise a plastic, a composite material, including a carbon-fiber composite or a mineral reinforced composite, or a metal and, further, may be formed from a single wire-shaped member.

In other aspects, the first spring portion is connected to the upper portion of the shoe by a pivot connection or a fixed or moment connection. Additionally, the connection between the first portion and the shoe may be adjustable to adjust the moment arm length and/or the spring constant of the spring members. Furthermore, each spring constant may be adjusted independently.

Accordingly, it can be appreciated that the footwear of the present invention is particularly suitable for use as athletic footwear, though not limited to athletic footwear. Further, the energy storage member or members facilitate an enhanced performance on behalf of the wearer and, further, provide a reduced risk of injury to the wearer's foot by providing a lateral stability while offering varying degrees of cushioning and energy return.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
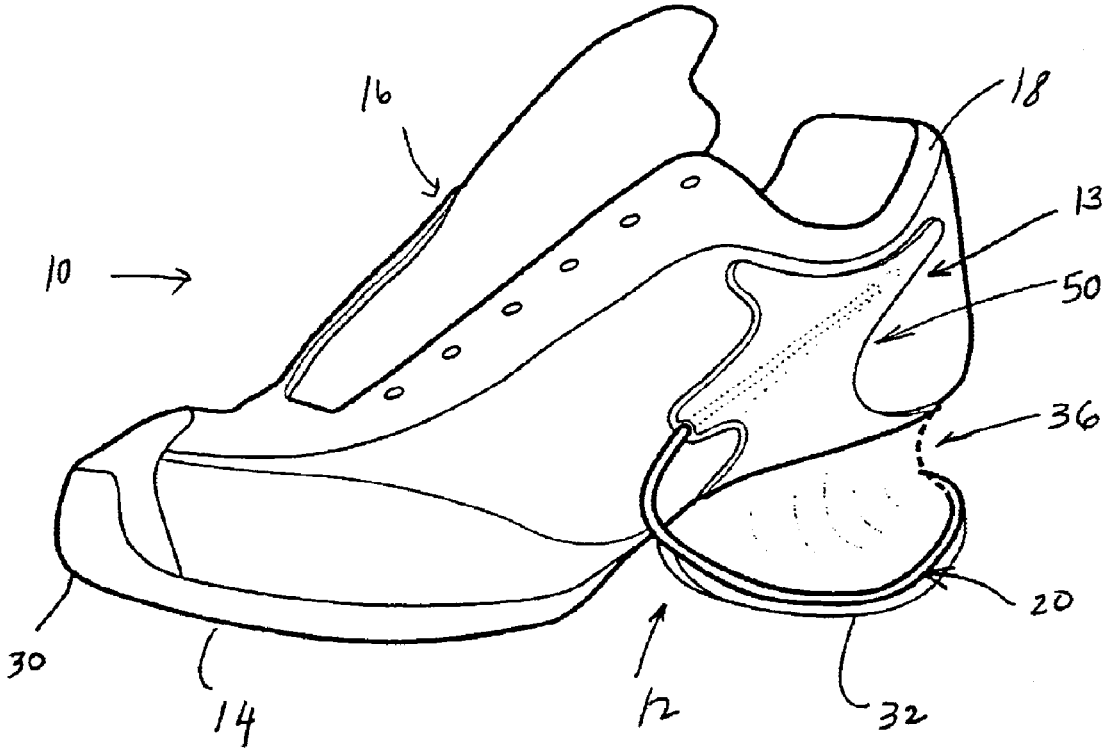
FIG. 1 is perspective view of the footwear of the present invention.

Referring to FIG. 1, the numeral 10 generally designates a shoe or article of footwear of the present invention. In the illustrated embodiment, footwear 10 comprises an athletic piece of footwear; however, it should be understood that various aspect of the footwear of the present invention may be incorporated into other types of footwear, including therapeutic footwear or everyday use footwear. As will be more fully described below, athletic footwear 10 incorporates an energy storage system 12 that reduces ground impact forces and, further, improves the performance of the user or wearer of the footwear. Optionally and preferably, energy storage system 12 provides a suspension system 13 that reduces the overturning moment forces on the user's ankle to thereby reduce the risk of injury to the wearer by diverting the initial ground reactions forces to a region above the bottom of the heel and, preferably, at or near to ankle joint, where the lateral forces are transferred to the ankle joint for lateral stabilization, and with the vertical forces directed down to the bottom of the heel; therefore, suspension system 13 effectively separates vertical and lateral forces and decouples shoe stability from cushioning and/or energy storage and return.

Footwear 10 includes a sole 14 and an upper portion 16, which encloses the foot of the wearer. Sole 14 is formed from a flexible impact absorbing material, such as rubber. Furthermore, as will be more fully described below, sole 14 may play an integral role in enhancing the performance of the wearer of footwear 10. Upper portion 16 forms a shell, which is preferably sculptured and shaped in order to most accurately conform to the user's foot shape. Suitable shells are preferably made is preferably made from light weight conventional materials or textiles, such as fabrics, leather, suede, or a combination of one or more of the above. Upper portion 16 may include cushioning material, such as neoprene foam or open celled foam, which may be positioned to evenly distribute forces from the foot to the shell by upper portion 16.

In the illustrated embodiment, upper portion 16 forms a low-rise athletic footwear and includes a collar 18, which surrounds or semi-encompasses the ankle joint. Preferably, collar 18 is located as high up on the ankle joint as possible, but without interfering with the naturally dorsi or flexion movements of the ankle joint. Optionally and preferably, collar 18 is held firmly against the talus bone by lacing or by a strap (not shown). It should be understood, however, that upper portion 16 may comprise a high-top type of shoe and may optionally include an opening at the ankle joint around the end of the fibula to avoid creating a pressure point at that point of the fibula. As described in co-pending application Ser. No. 09/878,021, filed Jun. 8, 2001, which is herein incorporated by reference in its entirety, suspension system 13 may be configured to provide the ability to directly transfer the lateral forces from the sole to a region above the bottom of the heel and, preferably, at or near the centroid of the ankle, with all the ground reaction forces by passing the calcaneus bone and related connective tissues, thus avoiding a potential overturning moment and potential ankle joint sprain.

Figure 2:
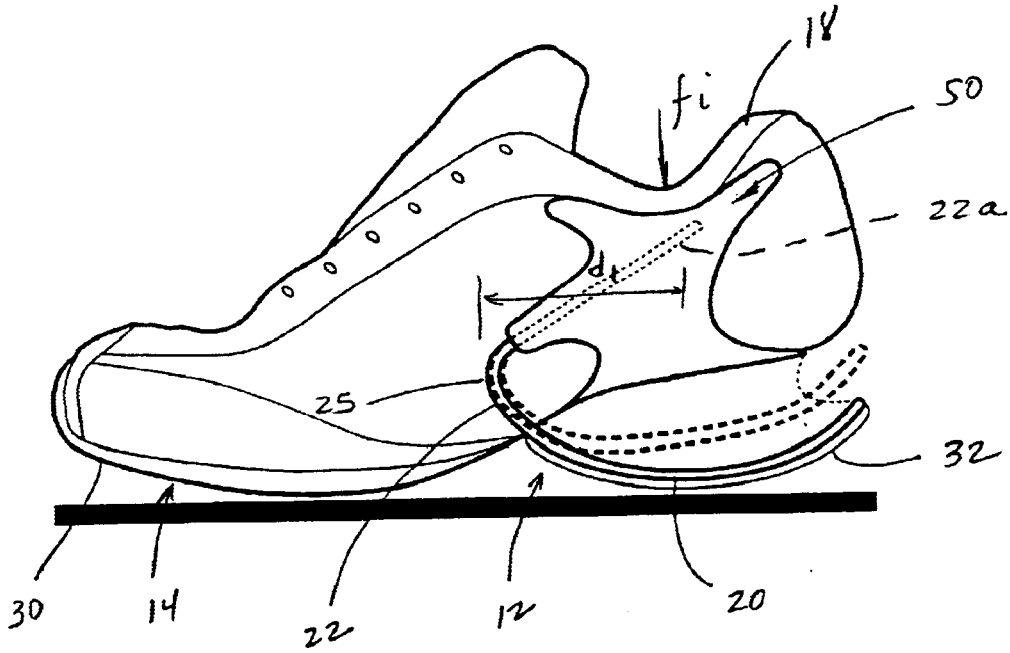
FIG. 2 is a lateral side elevation view of the footwear of FIG. 1.

Referring to FIG. 2, energy storage system 12 includes a spring 20 that includes two spring portions 22 and 24. Spring portions 22 and 24 are preferably sufficiently rigid, as described in the above-referenced co-pending application, to transfer reaction forces at the sole to a point above the bottom of the heel and, preferably, to a point at or near the user's ankle, such as at or near the centroid of the ankle joint. In this manner, the heel portion of the shoe is suspended by spring portions 22 and 24, for example, above the sole 14. Increased stability is created by both spring portions 22 and 24, which provide both a vertical resistance force and a lateral resistance force and supply lateral forces back towards the ankle joint, which are antagonistic to one another. Furthermore, spring portions 22, 24 also create counteracting lateral forces that serve to provide support in the lateral directions. As previously noted, spring portions 22, 24 are connected to upper portion 14 at a point above the heel and, preferably, at or near the user's ankle joint. By connecting spring portions 22, 24 to upper portion 16, spring portions 22, 24 transfer the initial edge forces that occur at sole 14 to upper portion 16—for example, where the connection point is aligned with the ankle joint, the forces are transferred directly to the height of the ankle joint. By transferring the reaction forces above the bottom of the heel, the energy storage system effectively transfers forces by-passing the calcaneus bone and related corrective tissues. More preferably, the reaction forces are transferred up to the height of the ankle joint centroid; thus, footwear 10 effectively eliminates the instability of the ankle joint by allowing the lateral forces to "by-pass" the bottom of the foot heel and be directly transferred into the bottom of the Tibia and Fibula bones. In addition, by connecting spring portions 22, 24 at or near upper portion 16, the sides of the spring portions will accommodate large amounts of vertical movement through the cushioning process and, further, will provide support throughout the entire cushioning range. Furthermore, this allows the upper portion of the footwear to re-orient the vertical forces back down to the bottom of the user's heel, while leaving the lateral forces transferred to the user at a distance above the user's heel; thus, decoupling the vertical and lateral forces prior to transferring the forces to the user's foot.

Though illustrated as comprising external components, it should be understood that spring portions 22 and 24 may be embedded into the shell 16 of shoe 10, such as by injection molding, so as to integrate the structural components with the finished exterior wear surface of footwear 10 or may be enclosed by a flexible membrane.

In the illustrated embodiment, spring portions 22 and 24 are formed by a single unitary spring formed from a wire-shaped member 21. Wire-shaped member 21 may be formed from a metal, a carbon fiber or a mineral reinforced composite plastic. Alternately, spring portions 22 and 24 may comprise two individual spring members connected together or two disconnected spring portions that are connected to a third member, such as a sole structure and/or air chamber. Furthermore, spring portions 22 and 24 may comprise pre-tensioned springs.

Figure 2A:
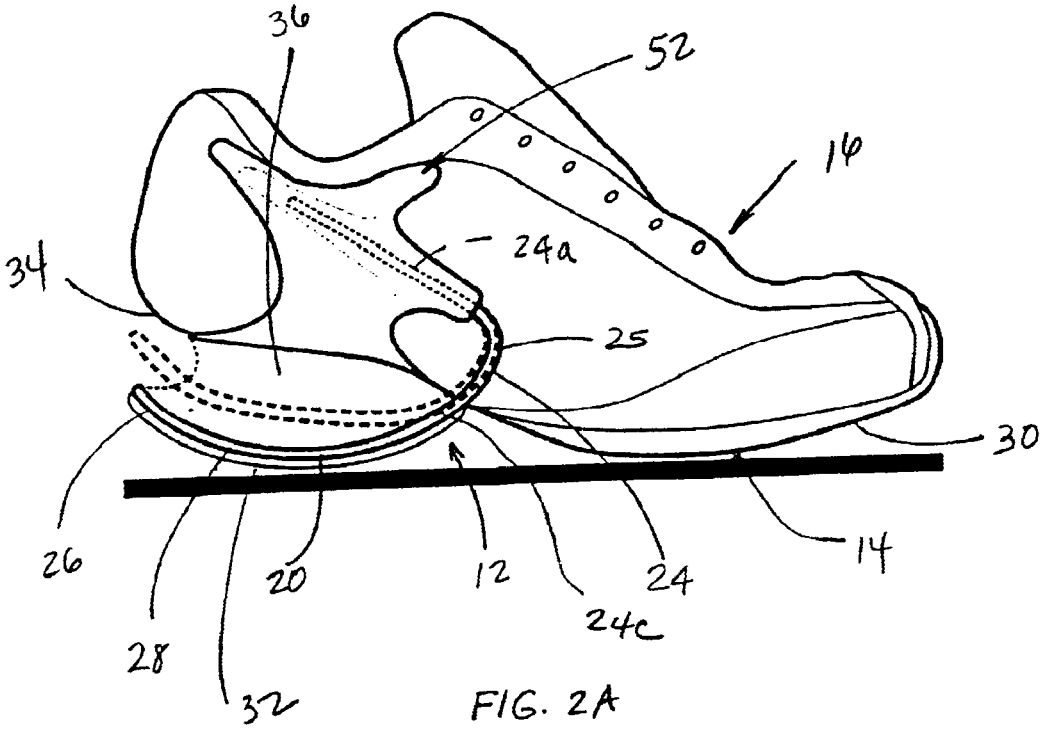
FIG. 2A is a medial side elevation view of the footwear of FIG. 1.
Figure 2B:
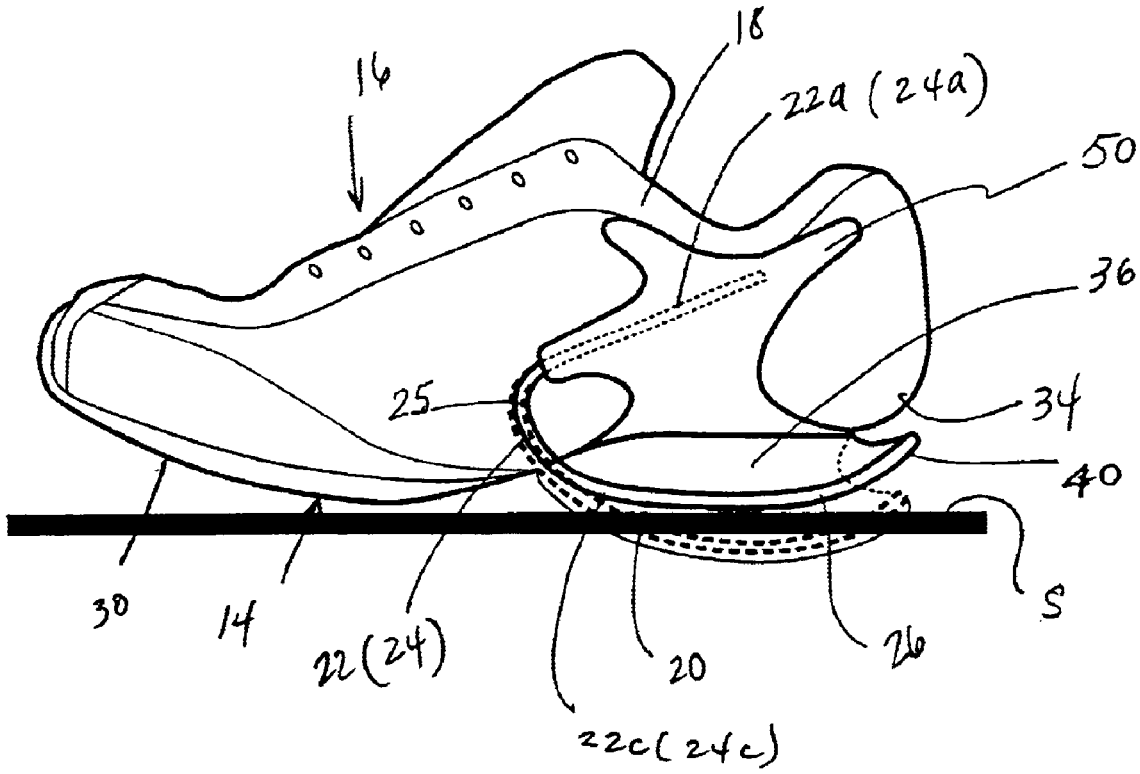
FIG. 2B is a similar view to FIG. 2 illustrating the footwear of FIG. 2 when subject to a vertical impact force, for example, after the user has made a heel strike.

As best seen in FIGS. 2 and 2A, each spring portion 22 and 24 has a generally C-shape, which in the illustrated embodiment are interconnected by a C-shaped base 26 that straddles the heel area of footwear 10 and connects to lower portions 22*c* and 24*c* of spring portions 22 and 24. Although illustrated as having similar configurations and, hence, similar resistances, spring portions 22 and 24 may have varying configurations and/or varying cross-sections to generate an asymmetrical spring system.

Each spring portion 22, 24 includes an upper portion 22*a*, 24*a* and lower portion 22*c*, 24*c*, which are interconnected by an intermediate or middle portion 25. Further, base 26 includes a curved bottom surface 28, which forms a rocker arm along with sole 14, as will be more fully described below. In the illustrated embodiment wire-shaped member 21 has a generally uniform cross-section; however, as it will be more fully described below, wire-shaped member 21 may have a varying cross-section, which may or may not provide a varying section-modulus.

As best understood from FIGS. 1, 2, 2A, and 3, sole 14 includes a forward sole portion 30 and a rearward sole portion 32. In the illustrated embodiment, sole portion 30 is separate and discrete from sole portion 32. However, it should be appreciated that forward sole portion 30 and rearward sole portion 32 may be formed from a continuous member that may transfer tension, compression, and/or moment forces to and from members 30 and 32. Forward sole portion 30 is provided at the forward portion of shell 16 and generally extends from the middle of the footwear forward to the toe area. Rearward sole portion 32 extends from the middle portion of the footwear to the heel area and, further, is spaced below the heel portion 34 of shell 16. In the illustrated embodiment, a cushioning member 36 is positioned between heel portion 34 of shell 16 and sole portion 32. Optionally, cushioning member 36 may comprise a solid compressible polymeric body, such as a neoprene foam body, or may comprise a hollow compressible polymeric body that forms a variable pressure bladder. In addition, the bladder may be filled with a liquid or pressured fluid, including pressurized air or other gas. In this manner, energy storage system 12 may include two distinct energy absorbing members, such as spring 20 (or spring portions 22 and 24) and cushioning member 36. Furthermore, in the illustrated embodiment, the energy absorbing members are arranged such that one of the energy absorbing members may dominate the distance over discrete ranges of motion of the footwear.

For example, spring 20 may provide the majority of resistance over a first range of motion, while cushioning member 36 may provide the majority of resistance over a second range of motion. For example, spring 20 may provide the majority of the resistance over the first range of motion where heel portion 34 of shell 16 deflects from its initial unloaded state to an initial loaded state where heel portion 34 deflects. Cushioning member 36 may provide the majority of resistance over a later, second range of motion when heel portion 34 deflects further from the initial loaded state. In this manner, cushioning member 36 provides the majority of the resistance over the last range of motion after spring 20 has deflected.

Figure 1A:
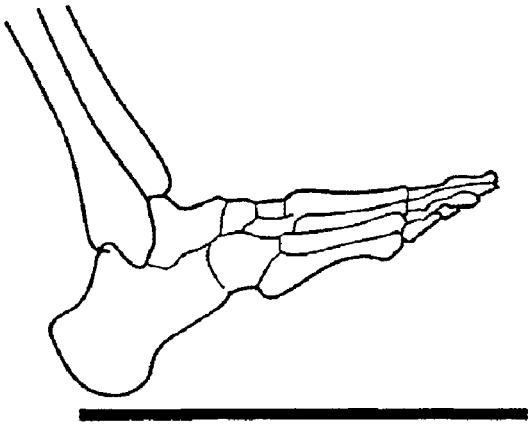
FIGS. 1A–1C illustrate a side view of a foot illustrating the bone structure of a foot and the plantar-flexion and the dorsi-flexion of the foot.
Figure 1B:
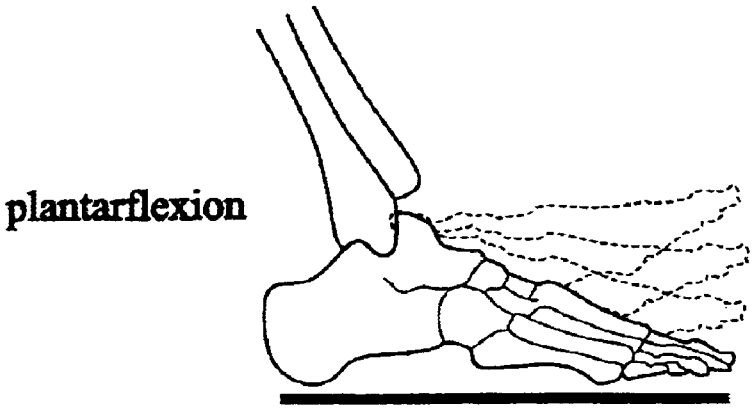
Figure 1C:
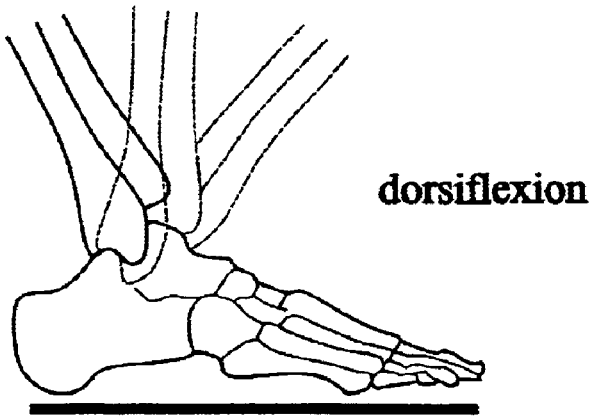
Figure 4:
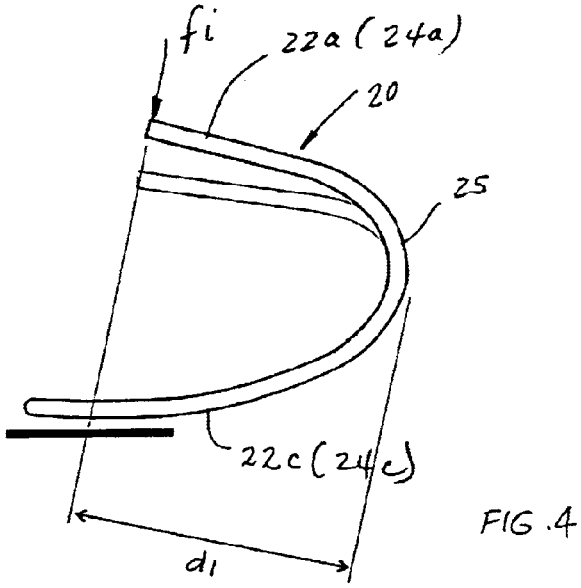
FIGS. 4–6 is a schematic view of one of the energy storage members of the energy storage system of FIGS. 1–3 illustrating the compression of the energy storage member due to the initial impact followed by forward rotation and, thereafter, release of the energy.
Figure 5:
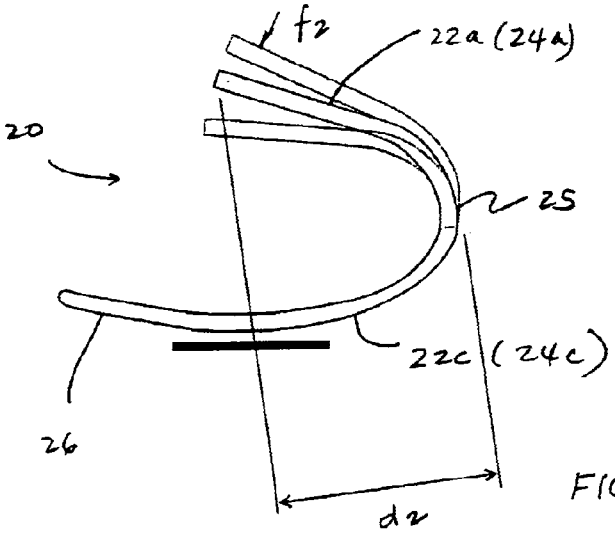
Figure 6:
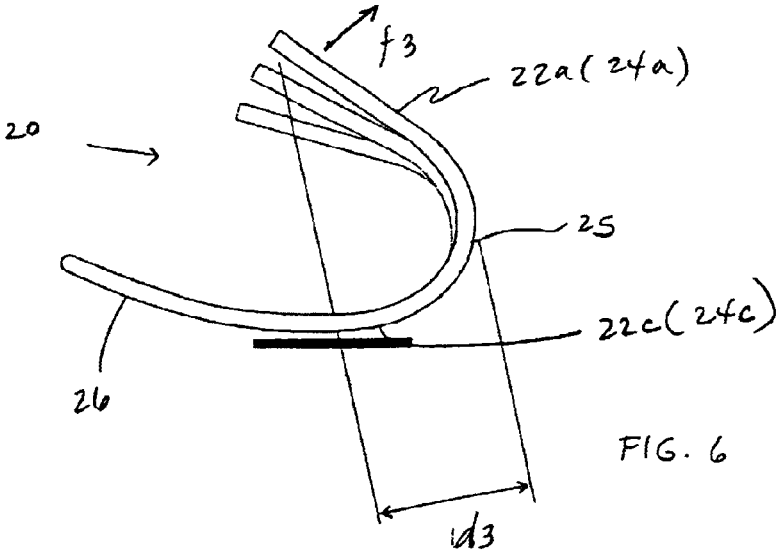

As noted above, energy storage system 12 converts at least some of the impact forces into propulsion forces. Referring to FIGS. 4–6, when a wearer is running and entering the first phase of the running profile, upper portions 22*a* and 24*a* of spring portions 22 and 24, respectively, will deflect relative to lower portions 22*c* and 24*c* and base portion 26 and, further, will deflect about middle portion 25. The impact force will flatten base portion 26 such that the rearward end 40 of base portion 26 deflects toward the impact surface S and, furthermore, such that heel portion 34 of shell 16 will compress cushioning member 36 wherein heel portion 34 moves close to rear portion 40 of base 26 of spring 20. With this initial impact, upper portions 22*a* and 24*a* of spring portions 22 and 24 will deflect at a point where the moment force equals the impact force of the wearer/user. As upper portions 22*a* and 24*a* compress and, further, as the body weight of the footwear user rolls forward such as illustrated in FIGS. 1A–1C, the moment arm distance d1 decreases and upper portions 22*a* and 24*a* continue to deflect. Upon initial contact of the shoe energy storage system with the ground, the spring and/or air chamber system will provide less resistance force than is necessary to equal the initial impact force of the wearer. This will result in a deflection of the energy storage system to a desired deflection at which time the increased deflection creates an internal combination or separate moment compression force equal to the wearer's initial force. At this point and time, the energy storage system will be at a maximum deflection and have a maximum potential energy storage. As the rotation continues about the ankle joint as the wear transfer forces from heel towards the forefoot, the energy storage system will then begin to supply a greater force than the wearer, causing a forward and vertical acceleration of the ankle joint due to the releasing of energy stored within the energy storage system. In this manner, the spring rotates forward during the absorption of the impact forces, and then releases the stored energy, for example, in a direction generally vertically and into the direction of forward momentum of the user. In other words, as the wearer continues to roll forward unto the forefoot, the spring will be so shaped as to create a zero deflection point at a location somewhere between the beginning or end of the forefoot pad location. This insures a smooth transition of forces from the rear suspension system, unto the forefoot without creating any undesirable force or deflection spikes or irregularities in a continuous and consistent transfer body weight and related internal forces. This creates a tapered deflection wedge with a zero deflection of sole suspension taking place somewhere below an area at or near the forefoot of said shoe. As would be understood, therefore, the vertical and forward components of the released energy can be varied as desired to customize the footwear to the ultimate user's needs.

Figure 3:
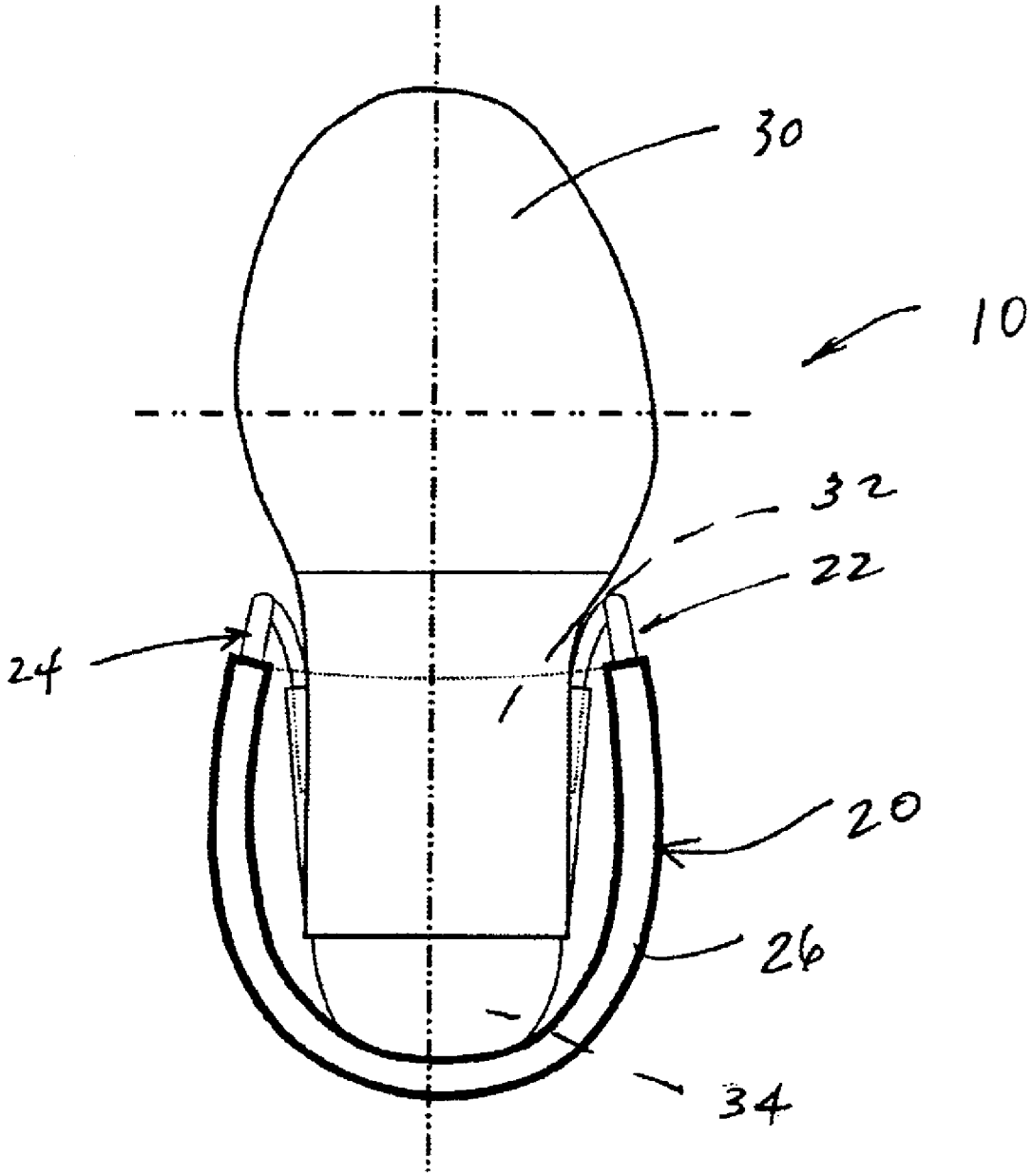
FIG. 3 is a plan view of the footwear illustrated in FIG. 2A.
Figure 18:
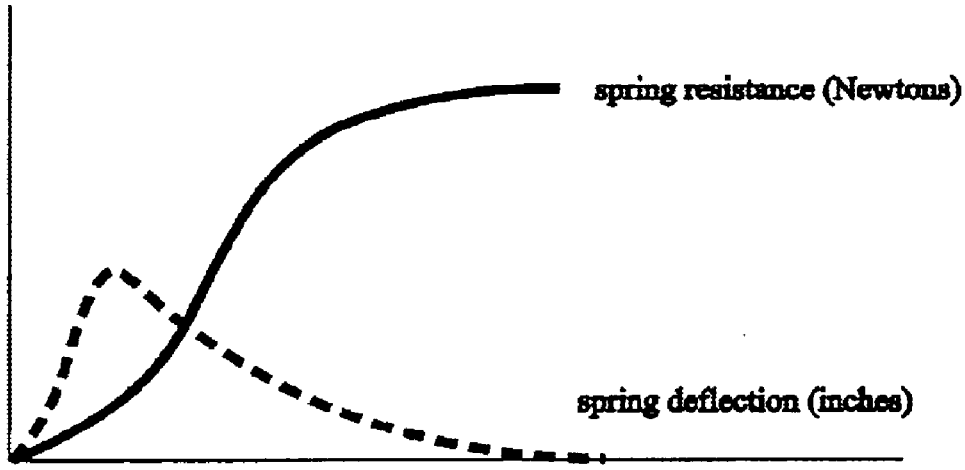
FIG. 18 is a graph illustrating the deflection and spring resistance of the energy storage system of the footwear of FIGS. 16 and 17.

The response (force) profile of spring 20 may be varied by varying the connection between spring 20 and shell 16, which will increase or decrease the resistance of the spring and, hence, the spring constant. For example, in the embodiment illustrated in FIGS. 2–3, upper ends 22*a* and 24*a* of upper spring portions 22 and 24 are fixedly mounted to the shell 16 and, further, are mounted in substantially rigid or semi-rigid lateral and medial supports 50 and 52 (FIGS. 2A and 3). Supports 50 and 52 are preferably formed or made from lightweight and rigid or semi-rigid material or rigid/semi-rigid thermo plastics or carbon-fiber/composites, reinforced thermo-formed plastics composites or a combination of one or more of the above. Similarly, lower portions 22*c* and 24*c* are fixed to sole 14. When the heel first strikes the ground, the spring constant of spring 20 is relatively low due to the long moment arm d2. This distributes the impact strike over a longer period of time. When the foot rotates into the mid-phase, where the load is generally centered over the middle of the foot, the moment arm becomes shorter d2, which causes an increase in the spring constant. This allows for the mid-phase to build up a load faster than a non-cushioned (or conventional foam cushioned sole) shoe. When the foot rotates through the forefoot phase, the spring constant increases again due to the effectively shorter moment arm d3. When sufficiently rolled or rotated about middle portion 25, spring 20 then returns some of the stored energy and generates a propulsion force that aids in propelling the runner through the next stride. It can be appreciated that the section modulus of cushioning member 36 and/or of spring 20 may be adjusted or may be varied along the length of the spring to engineer a different response profile, as will be more fully described in reference to the graph in FIGS. 15, 18, and 21. In addition, it should be understood that the energy storage members may be adjusted to produce a profile that becomes progressively stiffer as the runner's foot rotates through a stride, as described above, or a profile that becomes progressively less stiff, or a profile that starts soft and becomes stiffer then softens. It should also be noted that the set of springs may be of different response profiles in order to create an asymmetrical loading response to address corrective measures similar to conventional orthotics that assist in correcting the asymmetrical forces within the wear's foot.

In contrast to conventional running shoes, as noted above, footwear 10 has a non-planar bottom sole 14. In the illustrated embodiment, sole 14 includes a curved bottom surface at its rearward portion 32, which allows the user to run with much less or no ankle rotation. The curved rear sole portion also eliminates premature heel strike and delays the heel strike until later in the running stride; thus reducing the "passive" contact phase of the contact stride (proportionally to the "active phase of conventional footwear). As a result, the heel strike forces are moved forward on the foot into the mid-foot zone where the forces are more evenly distributed over the foot. Furthermore, by moving the heel strike forces forward, these forces are moved into the active phase of running. As a result, the runner expends less energy in the passive phase and, instead, applies more of the energy in the active phase (see FIG. 15). In addition, the curved portion of sole 14 allows for a contact point of varying length to continually change the distance with respect to the anchor point or attachment point of spring 20 to shell 16. The curved sole also allows sole 14 to deflect over a prescribed region of the sole. The curved sole also moves initial contact forward from wearer's heel, to a position in front or forward of the heel, thus moving initial contact forward into the 'active' phase of foot/ground contact. This allows the wearer more control of contact forces now located further into contact phase. This reduction of 'passive phase' of foot contact may lead to reduction of potential injury, due to the fact that ankle injuries are more likely to occur or begin in 'passive' contact phase. Other benefits provided by the curve portion include a reduction or elimination in heel contact with the ground while the user is rotating from a forefoot contact to an initial heel contact, typically known as heel scuffing or "catching of the heel".

It should be understood that although the upper portions 22*a* and 24*a* of spring portions 22 and 24 are illustrated as being mounted with a fixed connection to shell 16, upper portions 22*a* and 24*a* may be mounted by a hinge or pinned connection which would vary the stiffness of spring 20 and, hence, the response profile.

Figure 7:
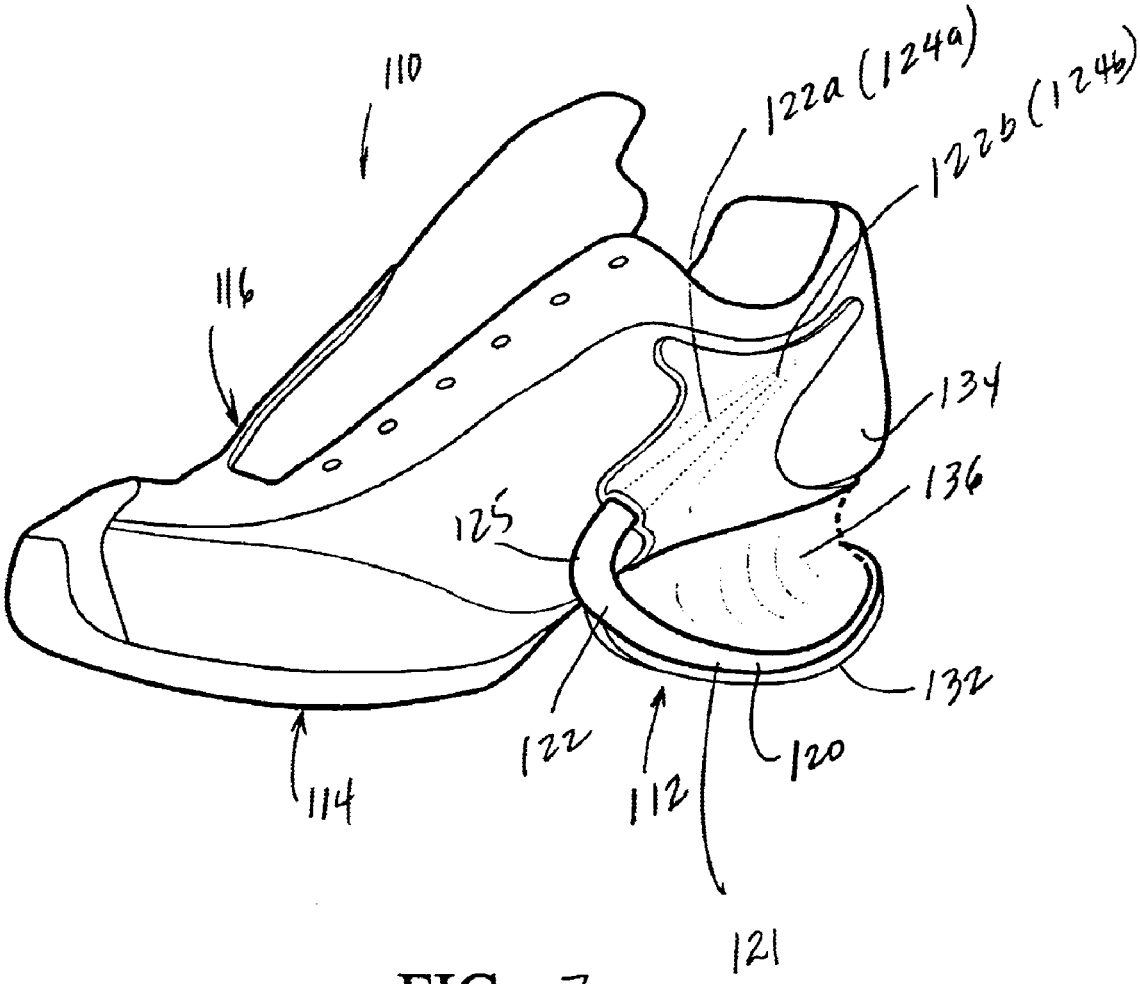
FIG. 7 is a perspective view of another embodiment of the footwear of the present invention.

Referring to FIG. 7, the numeral 110 generally designates another embodiment of the footwear of the present invention. Footwear 110 is of similar construction to footwear 10 and includes a shell 116, a sole 114, and an energy storage system 112, which operates in a similar manner to system 12, but produces a modified response profile. System 112 includes a spring 120, with first and second spring portions 122 and 124 that similarly absorb and store some of the impact forces and, further, translate some of the impact forces into propulsion forces to enhance the user's performance. In addition, energy storage system 112 similarly includes a cushioning member 136, which is positioned between the heel portion 134 of shell 116 and rearward sole portion 132 to provide additional cushioning and absorption of the impact forces.

In the illustrated embodiment, spring 120 comprises a wire-shaped member 121 which has a varying cross-section along its length, with the upper portions 122*a* and 124*a* of spring portions 122 and 124 having tapered cross-sections with their respective thicknesses gradually increasing from their respective distal ends 122*b*, 124*b* to the middle portion 125 of spring 120 and, thereafter, decreasing as wire-shaped member 121 extends from middle portion 125 to lower portions 122*c* and 124*c* and to where wire-shaped member 121 wraps around the cushioning member 136. In this manner, spring 120 exhibits reaction profile that becomes progressively stiffer as the runner's foot rotates through a stride and upon release becomes softer. As noted above, wire-shaped member 121 may be formed from metal, plastic, carbon-fiber composite, a fiberglass composite or the like.

Figure 8:
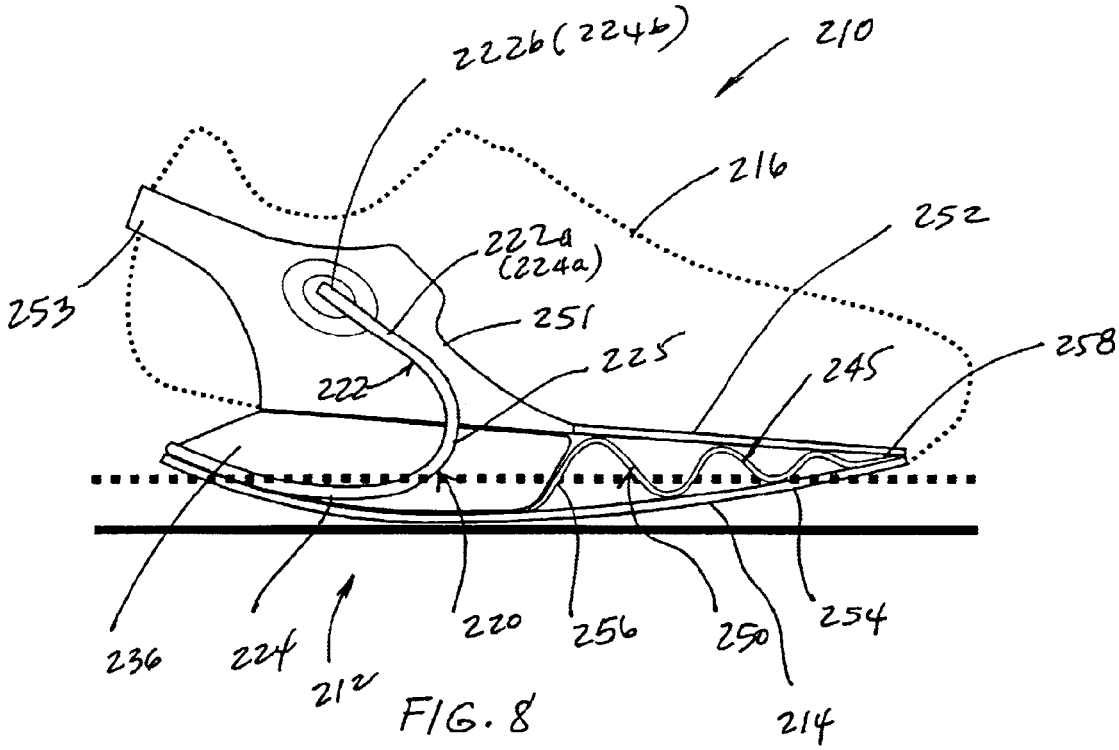
FIG. 8 is another embodiment of an energy storage system of the footwear of the present invention.

Referring to FIG. 8, the numeral 210 generally designates another embodiment of the footwear article of the present invention. Footwear 210 includes a shell 216, a sole 214, and an energy storage system 212 that is similar to the storage systems of the first and second embodiments with the addition of a third energy absorbing member 245. Energy absorbing member 245 optionally exhibits varying resistance whose resistance increases from the middle portion of footwear 10 to the toe region. However, it should be understood that energy absorbing member 245 may extend from the rear or heel portion of the footwear to provide varying degree of resistance and, further, deflection over substantially the entire length of footwear 10.

In the illustrated embodiment, energy absorbing member 245 comprises a sinusoidal-shaped cushioning member with one or more nodes 250, which is sandwiched between the lower front portion 252 of shell 216 and forward portion 254 of sole 214. Preferably, lower portion 252 of shell 216 includes a relatively rigid or semi-rigid surface in order to apply uniform pressure to the cushioning member. It should be understood that the frequency of the sinusoidal-shape of member 250 may be varied. For example, the height of the undulations 256 of member 250 may vary from 2 inches at their maximum height to 0.2 inches at their lowest height, with a preferred maximum height starting at about 1 inch. As noted above, the frequency of the undulations 256 may be varied to control the cushioning of the shoe with a lower frequency (i.e. fewer undulations) giving a softer cushioning and a higher frequency (i.e. greater number of undulations) providing a firmer cushioning. As a result, cushioning member exhibits a resistance that increases along the length of the spring.

In preferred form, the front end 258 of sinusoidal member 250 is anchored between upper surface 252 and forward portion 254 of sole 214 but with its other end free to elongate when a load is applied. In this manner, when a load is applied to member 250, member 250 will flatten and elongate toward the heel portion of footwear 10. In addition, this elongation may be adjusted or modified by varying the coefficient of friction between sinusoidal member 250 and surface 252 and between member 250 sole 214, for example, by providing a graphite or liquid lubricant, including Teflon tape or other dry lubricant coatings, or other friction reducing agents. Alternately, surfaces 252 and 254 may be adapted to have an increased resistance to create a firmer cushioning by sinusoidal member 250. Sinusoidal member 250 may be formed from a thermoplastic, such as ABS, polyethylene, polypropylene, nylon, Teflon or the like. Other suitable materials for member 250 may include advanced fiber reinforced composite materials or metals.

Sinusoidal member 250 may be housed or enclosed in, for example, a membrane, such as an air-tight membrane, which isolates member 250 from debris—in this manner, member 250 will be protected from dirt, dust, or other particles, which could interfere with the operation of spring member if dirt or dust or other particles become embedded or lodged in the lubricants used to facilitate the sliding action of member 250.

As previously noted, energy storage system 212 also includes a spring 220 and a cushioning member 236. In the illustrated embodiment, cushioning member 236 may provide a stop for the elongation of sinusoidal member 250 to thereby vary the stiffness of sinusoidal member 250. Furthermore, cushioning member 236 may merely provide a resistance to the elongation of sinusoidal member 250 so that in addition to providing a vertical stiffness to footwear 210, cushioning member 236 further provides a lateral stiffness that is in series with sinusoidal member 250.

Spring 220 is of similar construction to spring 20 and includes first and second spring portions 222 and 224 (FIG. 8A). In the illustrated embodiment, the distal ends 222*b* and 224*b* of upper portions 222*a* and 224*a* of spring portions 222 and 224 are hinged to footwear 210 and, preferably, to medial and lateral supports 251 and 253, which extend upwardly from cushioning member 236 to the region of shell 216 that extends at or near the ankle region of the user. By providing a hinge connection between upper portions 222*a*, 224*a* and shell 216, spring 220 has greater flexibility and will exhibit greater rolling when the user shifts his or her body weight forward in a similar manner to that shown in FIGS. 4–6, which may be more suitable in a running application of footwear 210. Furthermore, spring 220 will initially generate a softer response than that of spring 20.

Figure 9:
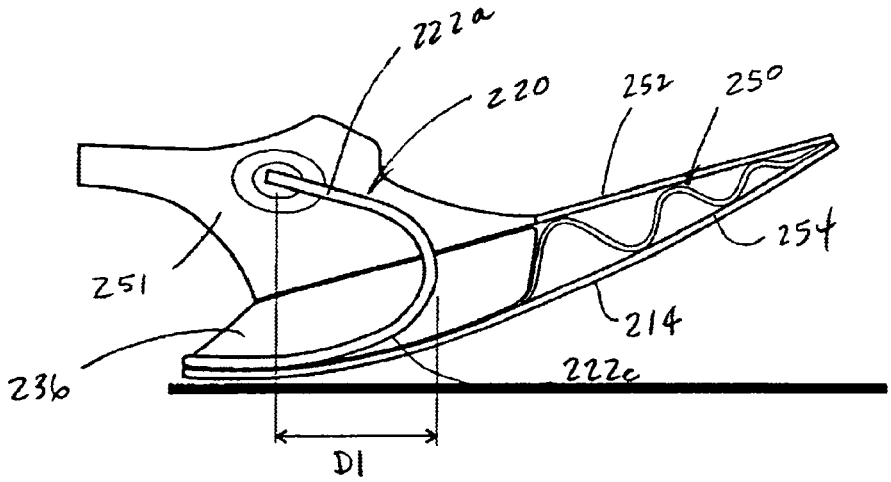
FIG. 9 is a side view of the energy storage system of FIG. 5 illustrating the energy storage system when initially compressed by an impact force from the user of the footwear.
Figure 10:
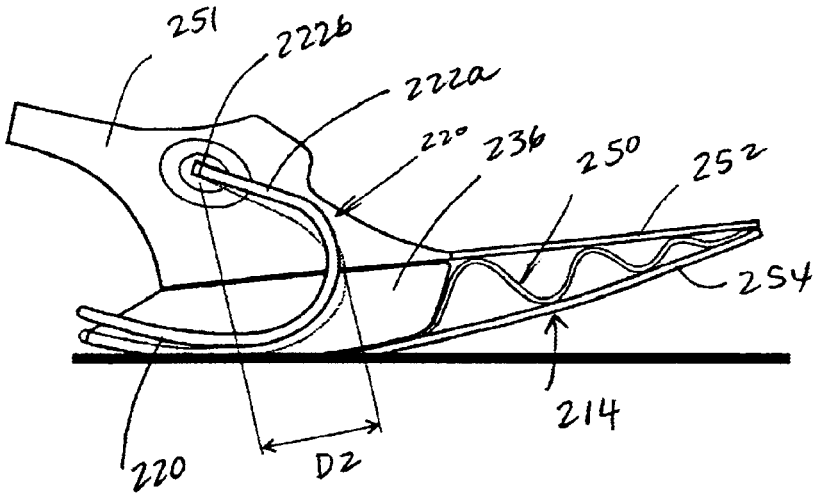
FIG. 10 is similar view to FIG. 9 illustrating the energy storage system after the initial impact force and when the user's body weight shifts forward.
Figure 11:
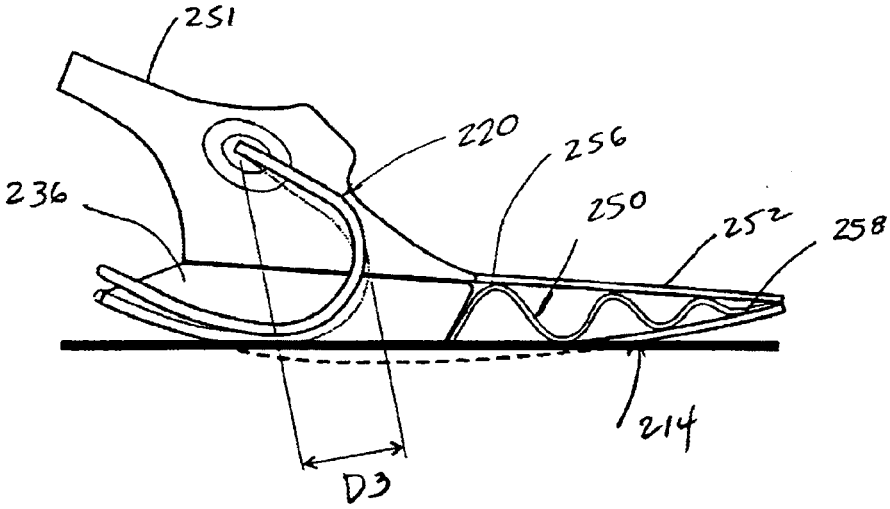
FIG. 11 is a similar view to FIGS. 9 and 10 illustrating the energy storage system as the user's body weight shifts further forward with the weight of the user shifting toward the forward portion or metatarsals in the foot.

Referring again to FIGS. 8–11, sole 214 comprises a generally bowed-shape sole with a curved lower surface that extends from the heel location through the middle portion and then to the toe region of footwear 10, with the middle portion forming the apex of the curved lower surface. In this manner when a user makes an initial contact with a ground surface, the sole 214 will create a rocking action (as shown in FIGS. 9–11) to shift the heel strike over a larger region of the sole, and hence the foot, and also over a longer period of time. The initial heel strike force is reduced due to the contact ground reaction force being moved forward, which distributes the load between the heel and forefoot. The rocking action also returns a portion of the energy directly back to the heel as the sole rocks from the middle portion to the forefoot or toe region of the footwear upon the rebound or spring-back of the rear energy storage member. A portion of this rebound force is directly transferred back to the heel and through the skeletal system. Thus, this leaves less force to be exerted by the forefoot. By transferring some of the energy return to the heel bone and into the skeletal bone system, the energy storage system also reduces the required loads unto the forefoot, thus requiring less force throughout the Achilles' tendon and related lever system of related selected and connective tissues.

In addition, when combined with spring 220, which exhibits a lower spring constant at the initial impact due to the longer moment arm D1, the impact forces are initially reduced with the foot rotating into the mid-phase, for example (in FIGS. 10–11) where the moment arm D2 shortens to increase the spring constant of spring 220. This allows the footwear to exhibit greater forces in the mid-phase. As the foot rotates from the mid-phase to the forefoot phase, the spring constant increases again as the moment arm decreases to D3, which results in return energy that creates a propulsion force to the runner through the next stride. Furthermore, as can be appreciated from FIGS. 9–11, sole 214 flattens or splays to distribute the impact force over a greater area of the foot to reduce the impact to the heel of the wearer.

Figure 12:
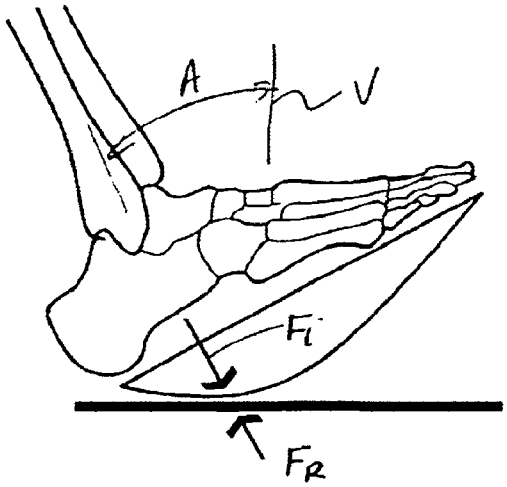
FIGS. 12–14 illustrate the rocking motion of the curved sole of the footwear illustrated in FIG. 5.
Figure 13:
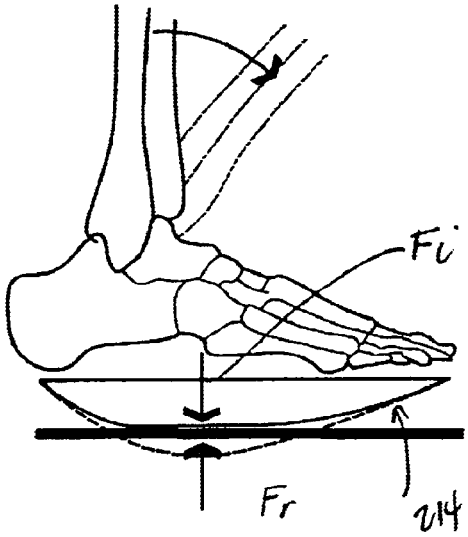
Figure 14:
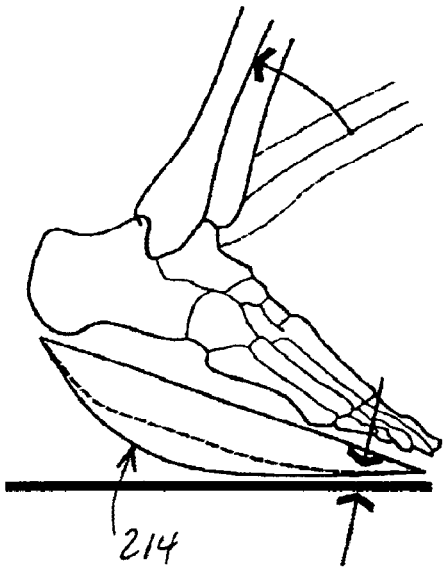

As best understood from FIGS. 12–14, the initial impact force Fi is in line with foot which approaches the ground surface at an angle; therefore, the impact force Fi is angled with respect to the vertical axis V, for example at an angle A typically in a range from 45° to 0°. With the curved bottom sole, the foot will rotate such the initial sole contact and related reaction force Fr are at a distance "d" in front of the bottom of the calcaneus bone, which is an initial contact point for typical shoe wear soles. Note that Fr will vary in force intensity along entire length of sole. As the user's body weight forward, sole 214 will rock forward similarly to the toe region or metatarsal region of the user where the propulsion forces are generated at or near the toe region and similarly over an increased area of contact as sole 214 compresses and deflects.

Figure 15:
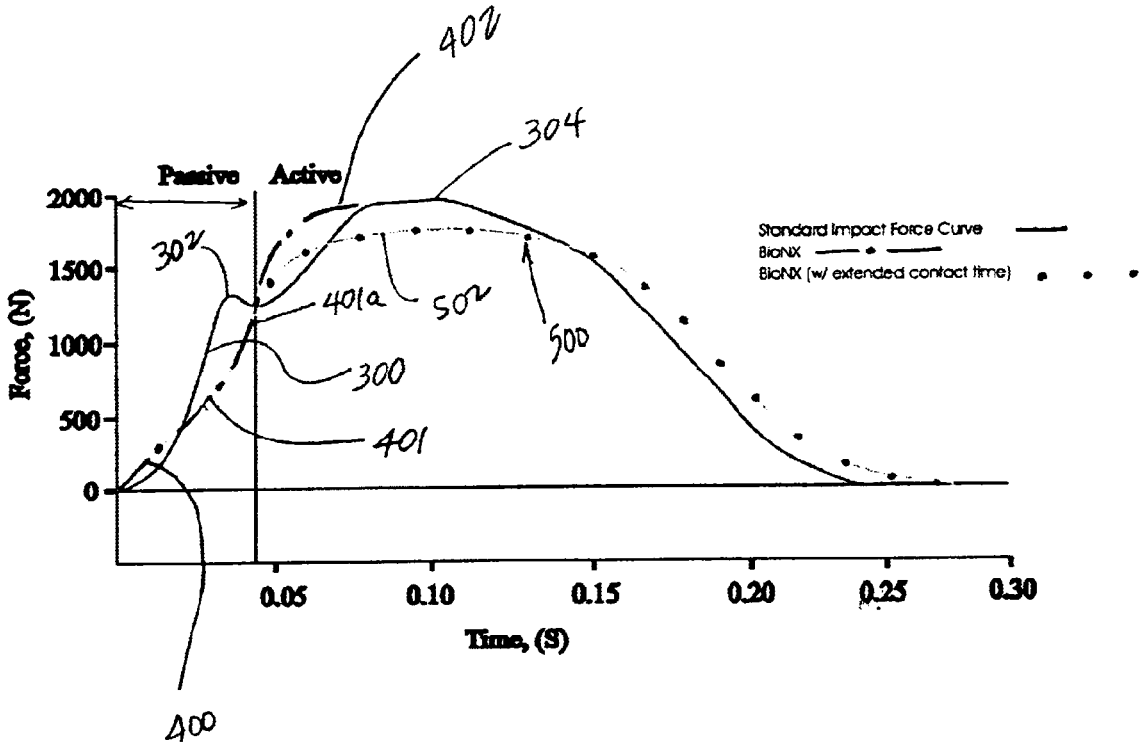
FIG. 15 is a graph illustrating and comparing a standard impact force with the curve of the impact force of the footwear of the present invention.

Referring to FIG. 15, it has been found that footwear of the present invention produces a significantly reduced impact force over the passive phase of the running process. A profile 300 of a conventional running shoe demonstrates that the impact forces during the passive phase reach a peak value 302 which thereafter diminishes and then increases again to a second peak value at 304, which corresponds to the active phase of the running process, and thereafter decays. In contrast, the profile 400 of the footwear of the present invention initially exhibits a generally linear increase (401) of the impact force, which then increases at a faster rate 401*a* but does not peak 402 until the footwear is in the active phase of the running process and thereafter decays similar to the profile of a conventional running shoe. Where the footwear of the present invention incorporates an extended contact time due in part to an increase in sole deflection distance—where the footwear incorporates a rocking member, for example,—it has been found that the impact force also initially increases generally linearly followed by a faster rate of increase through the passive phase and thereafter reaches its maximum impact force 502 further into the active phase, which is sustained over a greater period of time and then decays thereafter similarly to the previous profiles.

Figure 16:
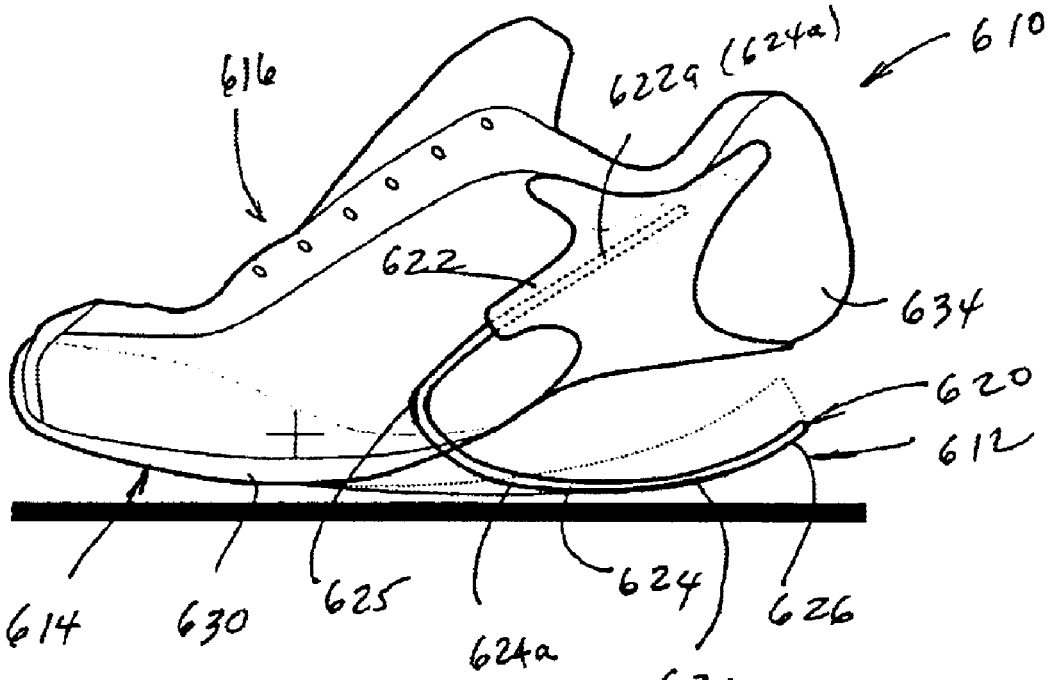
FIG. 16 is a side view of another embodiment of footwear of the present invention.
Figure 17:
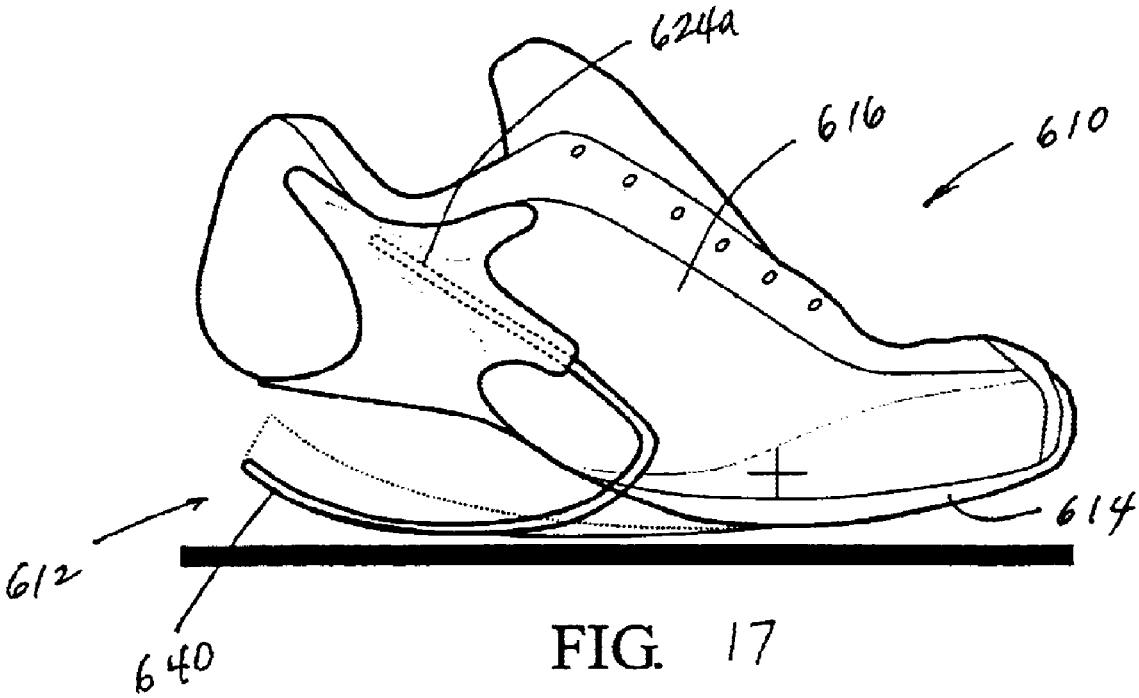
FIG. 17 is a second side view of the footwear in FIG. 16.

Referring to FIGS. 16 and 17, the numeral 610 designates yet another embodiment of the footwear of the present invention. Footwear 610 includes a sole 614, an upper portion 616, which encloses the foot of the wearer, and an energy storage system 612 similar to the previous embodiment. Energy storage system 612 includes a spring 620 that includes two spring portions 622 and 624, similar to spring portions 22 and 24. Although illustrated as having similar configurations and generally uniform cross-sections, spring portions 622 and 624 may have varying configurations and/or varying cross-sections to generate an asymmetrical spring system.

Sole 614 includes a forward sole portion 630 and a rearward sole portion 632, similar to sole 14. Forward sole portion 630 is provided at the forward portion of shell 616 and generally extends from the middle of the footwear forward to the toe area. Rearward sole portion 632 extends from the middle portion of the footwear to the heel area and, further, is spaced below the heel portion 634 of shell 616. In the illustrated embodiment, heel portion 634 of shell is not only suspended above rearward sole portion 632 by energy storage system 612 but also spaced from and generally not supported by rearward sole portion 632. In the illustrated embodiment, cushion member 36 is eliminated. In this manner, spring portions 622 and 624 provide the resistance over the full last range of motion of footwear.

Figure 17A:
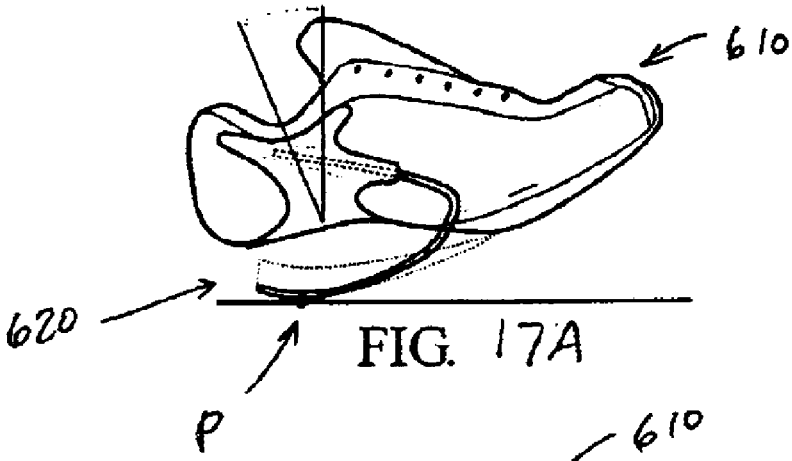
FIGS. 17A–17D illustrate the motion of the footwear of FIG. 17 as well as the deflection of the energy storage member of the energy storage system as the user moves through a stride.
Figure 17B:
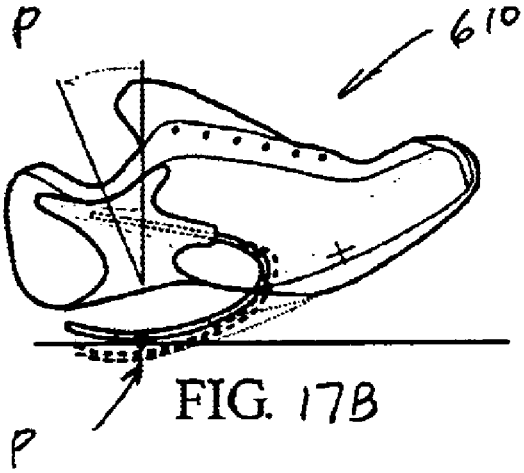
Figure 17C:
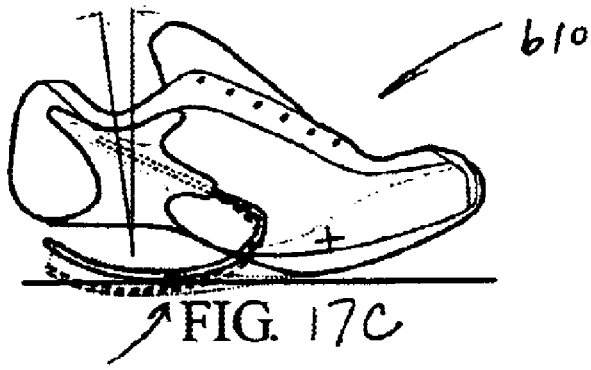
Figure 17D:
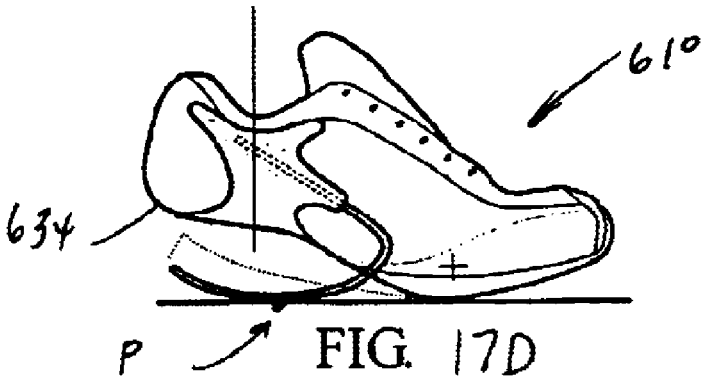
Figure 22:
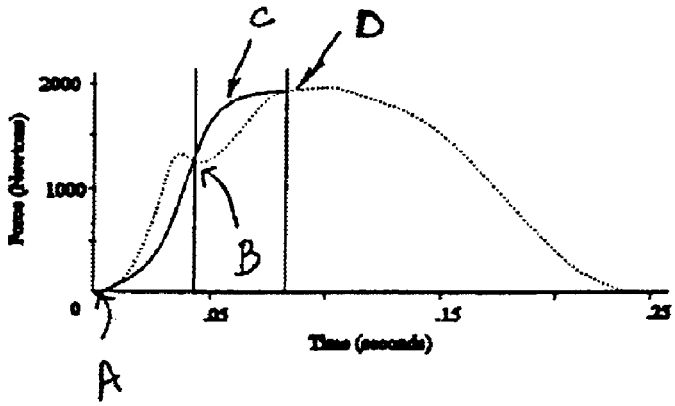
FIG. 22 is a graph illustrating the spring resistance of the energy storage systems of the footwear in FIGS. 17 and 19.

Similar to rearward sole portion 32, sole portion 632 is integrated with the lower portion 622*b*, 624*b* and base portion 626 of spring 620 and, further, has a curved bottom surface. As noted above, energy storage system 612 converts at least some of the impact forces generated by the user into propulsion forces. Referring to FIGS. 17A–17D, when a wearer is running and entering the first phase of the running profile, upper portions 622*a* and 624*a* of spring portions 622 and 624, respectively, deflect relative to lower portions 622*c* and 624*c* and base portion 626 and, further, will deflect about middle portion 625 (point A in FIG. 22). The impact force will flatten base portion 626 such that the rearward end 640 of base portion 626 deflects toward the impact surface S and, furthermore, such that heel portion 634 of shell 616 will deflect such that heel portion 634 moves close to rear portion 640 of base 626 of spring 620 (point B in FIG. 22). As upper portions 622*a* and 624*a* compress and, further, as the body weight of the footwear user rolls forward such as illustrated in FIGS. 17B–17C, the distance between upper portions 622*a* and 624*a* and lower portions 622*b* and 624*b* decreases and, further, contact point P shifts forward and eventually forward of the applied implied force to thereby shorten the moment arm (point C in FIG. 22). Similar to the previous embodiments, this will result in a deflection of the energy storage system to a desired deflection at which time the increased deflection creates an internal combination or separate moment compression force equal to the wearer's initial force. In addition, the energy storage system will be at a maximum deflection and have a maximum potential energy storage. As the rotation continues about the ankle joint as the wear transfer forces from heel towards the forefoot, the energy storage system will then begin to supply a greater force than the wearer, causing a forward and vertical acceleration of the ankle joint due to the releasing of energy stored within the energy storage system (point D in FIG. 22). In this manner, the spring rotates forward during the absorption of the impact forces, then releases the stored energy, for example, in a direction angled with respect to the initial impact force, for example generally vertically and into the direction of forward momentum of the user. As previously noted, the vertical and forward components of the released energy can be varied as desired to customize the footwear to the ultimate user's needs.

Figure 19:
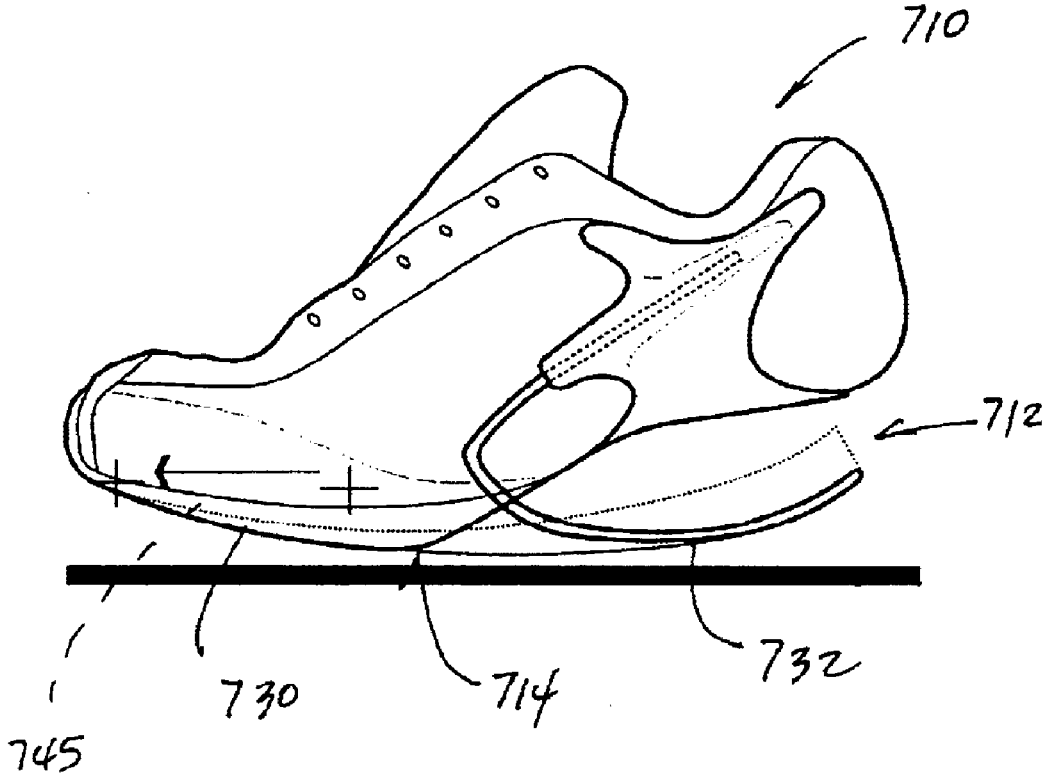
FIG. 19 is a side view of yet another embodiment of the footwear of the present invention.
Figure 20:
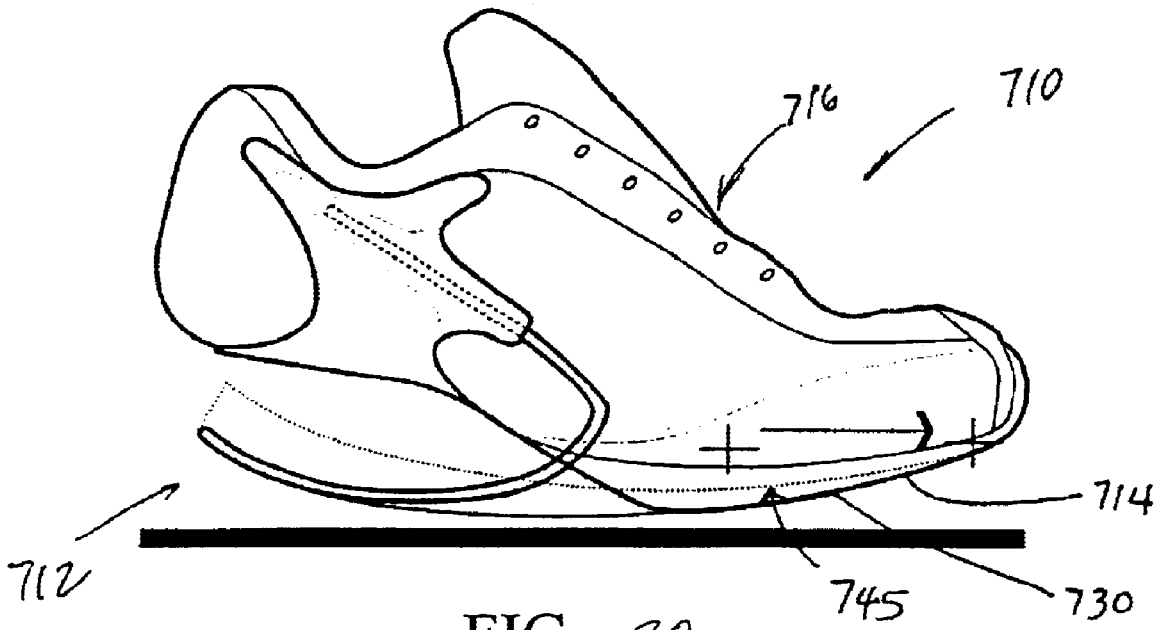
FIG. 20 is a second side view of the footwear in FIG. 19.

Referring to FIGS. 19 and 20, the numeral 710 generally designates another embodiment of the footwear of the present invention. Footwear 710 is of similar construction to footwear 610, and includes an energy storage system 712, a sole 714, and an upper portion 716. Energy storage system 712 includes a first energy storage member 720, which is of similar construction to spring 20, and a second energy storage member 745 in forward portion 730 of sole 714. For example, energy storage member 745 may comprise an open cushioning member, such as sinusoidal member 250, or may comprise a closed cushioning member, such as a bladder, or a generally solid cushioning member, such a foam member or the like.

Figure 21:
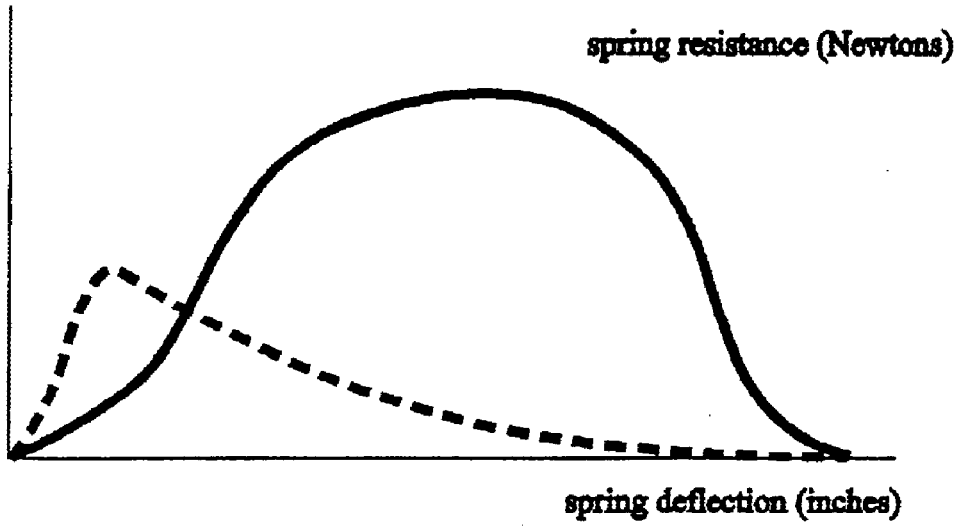
FIG. 21 is a graph illustrating the deflection and spring resistance of the energy storage system of FIGS. 19 and 20.
Figure 23:
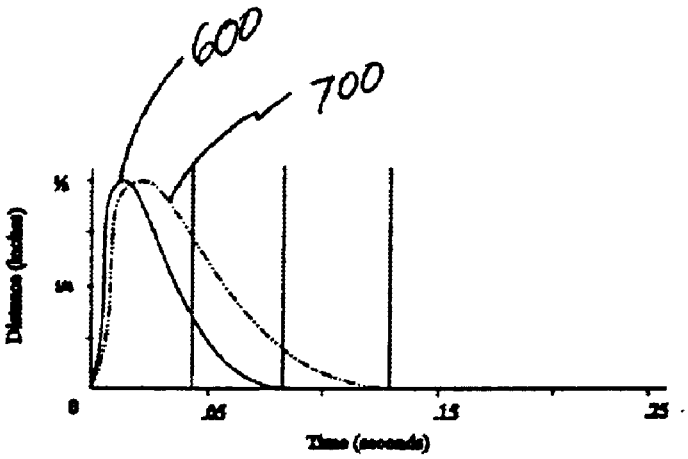
FIG. 23 is a graph illustrating the deflection of the energy storage systems of the footwear in FIGS. 17 and 19.

Referring to FIG. 21, with the combination of spring 720 and energy storage member 745, the deflection and resistance of energy storage system 712 is extended compared to that of system 612. In addition, referring to FIGS. 23 and 24, the deflection 700 is delayed and shifted forward relative to the deflection 600 of the energy storage system 612. Further, footwear 710 exhibits a deceleration/acceleration curve 702 that is similarly shifted forward relative to the deceleration/acceleration curve 602 of energy storage system 612.

Figure 24:
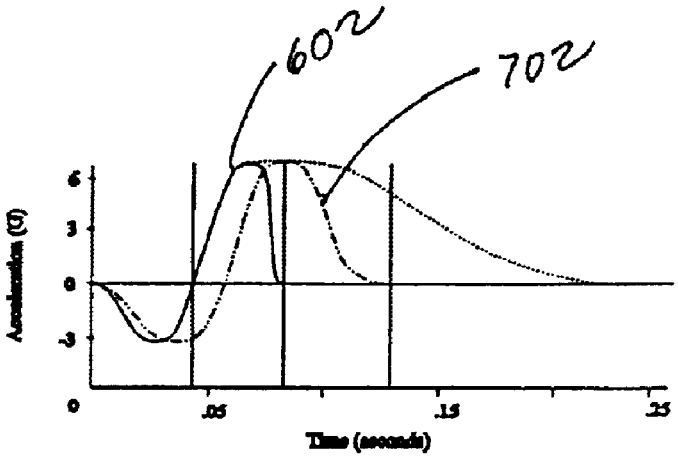
FIG. 24 is a graph illustrating the acceleration/decelerations of the energy storage systems of the footwear in FIGS. 17 and 19.

From the forgoing it can be appreciated that the various embodiments of the shoe of the present invention provide energy storage systems that reduce the risk of ankle sprain and injury and, further, reduce the effect of impact forces on the user's joints, including knees. The shoe decouples the lateral forces from the vertical forces so that the lateral forces can be transferred above the bottom of the heel and preferably to or near to the height of the ankle joint centroid, thus reducing or eliminating the risk of overturning moments in the ankle that can cause injury while at the same time allowing the ankle to maintain its full range of motion. In addition, the present invention provides both linear elastic and non-linear cushioning members to engineer the impact curve of the shoe. Thus, the footwear of the present invention may provide a low impact walking shoe that can be engineered to have an impact curve with a minimized maximum force observed, for example, by creating a square impact curve. The invention also provides a footwear that produces a low heel strike (such as in the impact curve illustrated in FIG. 15) or a footwear that produces an impulse at the forefoot. In addition, the time of the impact may be lengthened, such as shown in FIG. 24.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

I claim:

1. An article of footwear comprising:

an upper portion forming a shell, said shell having a heel portion and a toe region;

a sole, said sole having a heel portion and a toe portion; and an energy storage system, said energy storage system extending between said upper portion and said sole, said energy storage system comprising a first spring provided at or adjacent a medial side of said shell and a second spring provided at or adjacent a lateral side of said shell, each of said springs having a generally C-shape with an upper portion and a lower portion interconnected by an intermediate portion, said upper portions rolling forward relative to said lower portions when said sole makes contact with a ground surface such that said upper portions' moment arms relative to said intermediate portions decrease when said upper portions roll forward to thereby increase the stiffness of said springs wherein said springs convert an impact force generated by the user at or near said heel portion of said shell into a propulsion force to thereby enhance a user's performance.

2. The article of footwear according to claim 1, wherein said springs compress when said sole makes contact with a ground surface with said heel portion of said sole from a first configuration to a second configuration and rebound from said second configuration to a third configuration different from said first configuration wherein said upper portions are shifted forward relative to said lower portions such that said springs rebound to generate a propulsion force in a direction angled with respect to the direction of the impact force.

3. The article of footwear according to claim 2, wherein, said springs rebound to generate a generally horizontal propulsion force.

4. The article of footwear according to claim 2, wherein said springs rebound to generate a generally vertical propulsion force.

5. The article of footwear according to claim 2, wherein said energy storage system member comprises a wire-shaped member.

6. The article of footwear according to claim 5, wherein said wire-shaped member comprises a metal wire-shaped member.

7. The article of footwear according to claim 5, wherein said wire-shaped member includes a longitudinal extent and a generally uniform cross-section along said longitudinal extent.

8. The article of footwear according to claim 5, wherein said wire-shaped member includes a longitudinal extent and a varying cross-section along said longitudinal extent.

9. The article of footwear according to claim 1, wherein said first spring and said second spring arc co-joined by a generally C-shaped base, said C-shaped base extending around said heel portion of said sole.

10. The article of footwear according to claim 2, further comprising a second energy storage member positioned between said heel portion of said shell and said heel portion of said sole.

11. The article of footwear according to claim 10, wherein said second energy storage member comprises a compressible body.

12. The article of footwear according to claim 11, wherein said compressible body comprises a compressible bladder.

13. The article of footwear according to claim 2, wherein said energy storage system suspends said heel portion of said shell above said heel portion of said sole wherein said heel portion of said shell does not make contact with said sole when said springs are in said first configuration or said third configuration.

14. The article of footwear according to claim 1, wherein said energy storage system extends between a point above the heel portion of the upper portion and said sole portion.

15. The article of footwear according to claim 14, wherein said point is at or near an ankle of a user of the article footwear.

16. An article of footwear comprising:

an upper portion, said upper portion forming a shell, said shell including a heel portion and a toe portion and having a longitudinal axis;

a sole, said sole including a heel portion and a toe portion;

a pair of spring portions, said spring portions transferring a reaction force from said sole to said upper portion, each of said spring portions including an upper spring portion connecting to said upper portion, a lower spring portion connecting to said sole, and a middle portion extending between said upper and lower spring portions, said middle portions being forward relative to said upper and lower spring portions wherein said upper spring portions deflect about said middle portions to define a first moment arm when said sole makes initial contact with a ground surface with said heel portion of said sole, said upper spring portions translating forward with respect to said lower spring portions when the user's body weight shifts forward, and said upper spring portions rolling about said middle portions as the user's body weight continues to shift forward and, thereafter, generating a propulsion force for the user of the footwear.

17. The article of footwear according to claim 16, wherein said upper and lower spring portions are anchored to said upper portion and said sole, respectively.

18. The article of footwear according to claim 17, wherein said upper spring portions are anchored to said upper portion above said heel portion of said upper portion.

19. The article of footwear according to claim 16, wherein said pair of spring portions comprise generally C-shaped spring portions.

20. The article of footwear according to claim 19, further comprising a C-shaped base member interconnecting said generally C-shaped spring portions.

21. The article of footwear according to claim 20, wherein said wire-shaped member has a varying property, said property comprising at least one property selected from a cross-section, a section modulus, and a moment arm.

22. The article of footwear according to claim 20, further comprising a wire-shaped member, said wire-shaped member forming said C-shaped spring portions and said generally C-shaped base member.

23. The article of footwear according to claim 22, wherein said wire-shaped member has a generally uniform cross-section.

24. The article of footwear according to claim 23, wherein said wire-shaped member has a tapered cross-section extending from a middle portion of each of said C-shaped spring portions to a distal end of each of said C-shaped spring portions and from said middle portion of each of said C-shaped spring portions to said C-shaped base member.

25. The article of footwear according to claim 22, wherein said wire member comprises a metal wire member.

26. The article of footwear according to claim 16, wherein said sole includes a curved sole portion to form a rocker member.

* * * * *

UNITED STATES PATENT AND TRADEMARK OFFICE

CERTIFICATE OF CORRECTION

PATENT NO. : 6,964,119 B2
APPLICATION NO. : 10/407121
DATED : November 15, 2005
INVENTOR(S) : Robert B. Weaver, III It is certified that error appears in the above-identified patent and that said Letters Patent is hereby corrected as shown below:

Column 8:
Line 56, "d2" should be --d1--.

Column 9:
Line 16, "wear's" should be --wearer's--.

Column 15:
Line 21, Claim 9, "arc" should be --are--.

Signed and Sealed this

Sixteenth Day of January, 2007

JON W. DUDAS
*Director of the United States Patent and Trademark Office*